United States Patent [19]

Drew et al.

[11] 4,411,429

[45] Oct. 25, 1983

[54] OFFSET PUTTER

[76] Inventors: John W. Drew, RR #2 Denmark Rd.; Joe M. Swift, 1227 N. Walnut, both of Danville, Ill. 61832

[21] Appl. No.: 332,247

[22] Filed: Dec. 18, 1981

[51] Int. Cl.[3] ..... A63B 53/04; A63B 53/02

[52] U.S. Cl. ..... 273/164; 273/80 C

[58] Field of Search ..... 273/80 C, 164, 167 G, 273/167 K, 163 R, 163 A, 167 D, 169, 167 R, 167 A, 167 B, 167 C, 167 F, 167 J, 168; D21/214–220

[56] References Cited

U.S. PATENT DOCUMENTS

| | | | |
|---|---|---|---|
| 1,631,504 | 6/1927 | Redman | 273/80 C |
| 1,705,250 | 3/1929 | Hincks | 273/164 |
| 3,077,350 | 2/1963 | Koorland | 273/164 |
| 3,448,981 | 6/1969 | Anweiler | 273/80 |
| 3,539,184 | 8/1970 | Koorland | 273/77 |
| 3,549,300 | 7/1970 | Pelz | 273/162 |

FOREIGN PATENT DOCUMENTS

| | | | |
|---|---|---|---|
| 465643 | 5/1937 | United Kingdom | 273/164 |

*Primary Examiner*—George J. Marlo
*Attorney, Agent, or Firm*—Eric P. Schellin

[57] ABSTRACT

A golf putter is disclosed comprising a shaft, an offset portion and a head. The head is laterally and vertically displaced from the shaft by the offset portion. The head is attached to the offset portion is such a way that when the putter is properly positioned for ball to club alignment, the offset portion is attached to an end portion of the head furthest from the golfer's body. The view presented thereby is of a shaft which appears to pass in a parallel but laterally displaced plane in front of the head. As viewed by the golfer, the golf ball appears to be bracketed by the head, offset portion and the shaft.

11 Claims, 6 Drawing Figures

OFFSET PUTTER

BACKGROUND OF THE INVENTION

This invention relates to a golf putter having an offset head.

Golf is an extremely popular game in the United States and around the world. In pursuit of this sport, new developments in the golf ball and golf club art are continually coming to light. Golfing enthusiasts seize upon these developments in hopes that their golf game will improve.

It has been determined that the control afforded a golfer over a golf ball is determinate on the positioning of the shaft of a golf club in relation to the golf club head. As a result, a plurality of golf clubs have been developed which have various configurations of golf club shafts.

Some examples of golf clubs which have arrangements to enhance the control of the golfer over the golf ball are U.S. Patents to Redman No. 1,631,504; Koorland, U.S. Pat. No. 3,077,350; Anweiler, U.S. Pat. No. 3,448,981; Koorland, U.S. Pat. No. 3,539,184 and Pelz, U.S. Pat. No. 3,549,300. These patents disclose various arrangements in which a shaft is positioned in relation to a club head in such a manner to enable a golfer to better align his stroke.

Accordingly, an object of this invention is to enable a golfer to have maximum control over his stroke.

Another object is to provide a golf putter wherein the shaft appears to pass in front of a golf ball when the putter is aligned with the ball allowing the golfer's hands to pull through the ball for a natural pendulum motion.

Still another object is to provide a golf putter wherein the hands of the golfer on the shaft are automatically kept ahead of the putter head even though vertically displaced from the head.

A further object is that when the golfer has positioned the putter so as to strike a golf ball, the golfer can look down to see the ball apparently bracketed between the golf putter shaft, the goosenecked section and the head.

Another object is that the shaft is attached by means of an offset portion to the end of the head furthest from the golfer's body when the putter is positioned in a striking position.

The above-mentioned and other features and objects of this invention and the manner of attaining them will become more apparent and the invention itself will be best understood by reference to the following description of an embodiment of the invention taken in conjunction with the accompanying drawings.

SUMMARY OF THE INVENTION

In the arrangement of the present invention, the putter consists of a vertical shaft, an offset portion and a head. The head is displaced from the shaft by means of the offset portion which is attached to the head at the end which is positioned furthest from the golfer's body. This arrangement allows the shaft to pass in front of the head in a plane parallel to the head when viewed by the golfer.

As viewed by the golfer it appears that once the putter is correctly positioned for a putt, the golf ball is bracketed by the head, offset portion and the shaft. This allows the golfer to use the bracketing arrangement as a reference to insure that the putter is properly positioned.

The unique positioning of the shaft in relation to the head enables the golfer to exert a maximum amount of control over his stroke. Since the golfer's hands on the shaft are situated in front of the ball he is able to pull the ball through which enables the golfer to get a more solid feel. The result is a natural pendulum motion during the course of the stroke.

In addition, the unique positioning of the shaft in relation to the head allows the golfer to achieve maximum visibility during the positioning of the putter in relation to the golf ball.

DESCRIPTION OF THE PREFERRED EMBODIMENTS

Figure 1:
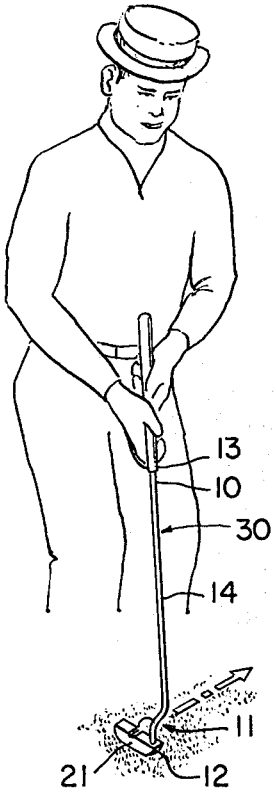
FIG. 1 is a top perspective view illustrating a golfer holding a putter incorporating the structure of the present invention.

As seen in FIG. 1 the golf putter 30 of this invention is comprised of a shaft 10, an offset portion 11 and a head 12. The shaft 10 consists of grip portion 13 and shank 14. As shown in greater detail in FIG. 4, the bottom end of the shank 14 terminates in the offset portion 11 which consists of upstanding portion 16, intermediate portion 15 and downward portion 17.

As shown, the upstanding portion 16 describes an elbow equal to or greater than 90°. The intermediate portion is essentially straight. As a result, it will be seen that the beginning portion of the shank is both displaced horizontally and vertically from the upper surface 18 of the club. Both of these displacements are essential to achieving the desirable characteristics of the club of the present invention. A club having only horizontal displacement from the upper surface 18 before beginning with shank 14 would be difficult to manufacture and would provide a forwardly positioned barrier to the golf ball itself. For this reason downward portion 17 provides vertical displacement of the intermediate portion 15 from the upper surface 18. In the construction hereinbefore detailed, the intermediate portion 15 is at an angle of 0° to 60° with respect to the upper surface 18 of the club. Although the preferred embodiment is to have the intermediate portion 15 at approximately 45° with respect to the upper surface 18 of the club.

Figure 2:
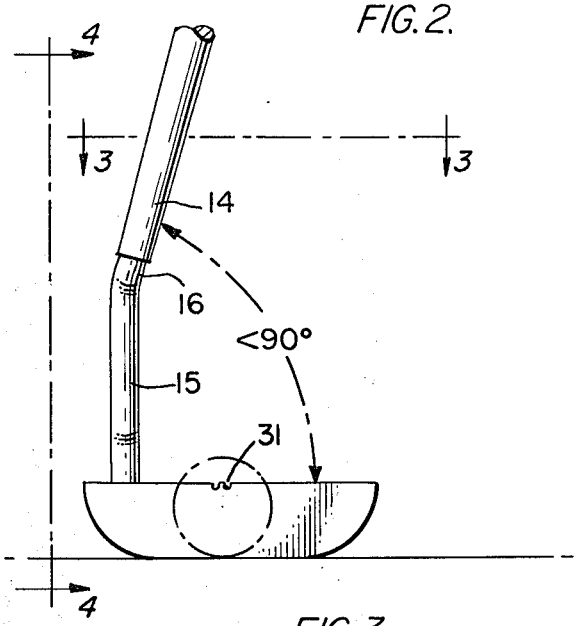
FIG. 2 is a side plan view of the putter head, offset portion and shaft.

Likewise the shank 14 is positioned at an acute angle with respect to the major portion of the upper surface 18 of the club as presented. As shown in FIG. 2 the shank 14 is at an angle of less than 90° from the upper surface 18 towards the inner end of the head 23. It will be appreciated that conventional clubs have shafts which are positioned at an angle of greater than 90° with respect to the head of the club.

Figure 3:
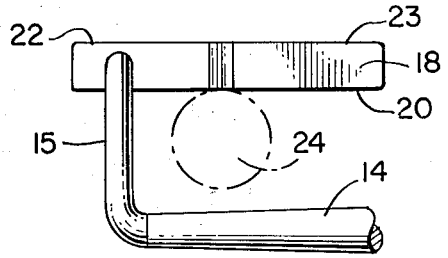
FIG. 3 is a top view of the head, offset portion and shaft taken on line 3—3 of FIG. 2.
Figure 3A:
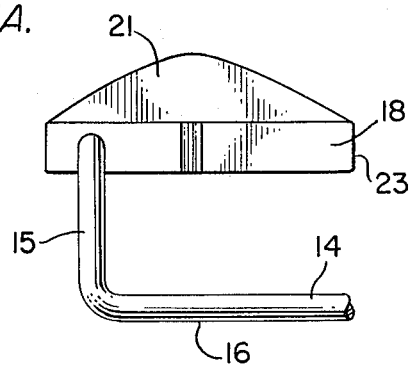
FIG. 3A is another embodiment of top view of the head, offset portion and shaft.
Figure 4:
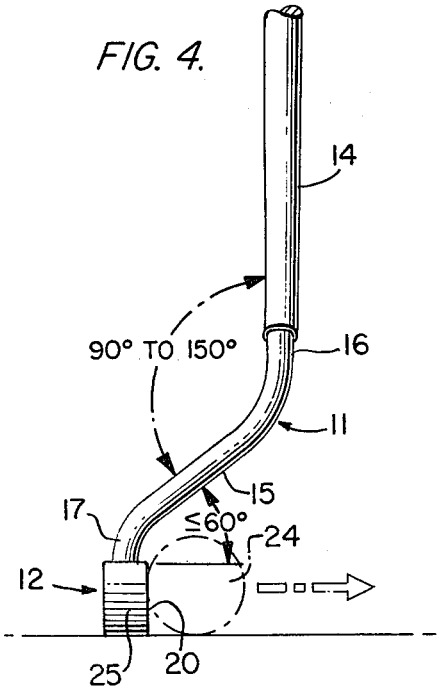
FIG. 4 is a rear plan view taken on line 4—4 of FIG. 2.
Figure 4A:
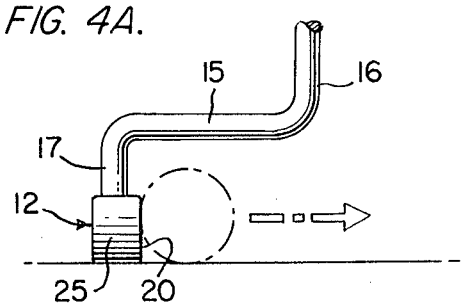
FIG. 4A is another embodiment of a rear plan view.

As shown in FIGS. 3 and 4, the head 12 consists of a solid metal body having a substantially horizontal upper surface 18, a vertically depending forward face 20, a vertically depending rearward face 21 and a lower surface 25. To differentiate one end of the head from the other end there is an outer end 22 and an inner end 23. As shown in FIG. 2 the inner and outer ends are symmetrical and are substantially curved towards one another along the lower surface 25.

The upper surface 18 of the club is provided with centering notches 31 which may be used for selective alignment as necessary. The use of the notches to align the ball with the club is discretionary, but does permit for the possibility of repeated identical strokes.

In use, the golfer grips the putter 30 by grasping the grip portion 13 with his hands. When the putter 30 is held as if to strike golf ball 24 as shown in FIG. 1, the shaft 10 passes in front of the head 12 in a substantially parallel plane to the head. The forward face 20 is positioned adjacent golf ball 24 so that the outer end 22 of the head to which the downward portion 17 is attached is situated furthest from the golfer's body. As the golfer looks down as shown in FIG. 3 the golf ball 24 appears to be bracketed or boxed between the forward face 20, the intermediate portion 15 and the shank 14. Due to the forward parallel alignment of the shaft 10 to the head 12 the golfer is able to exert a maximum amount of control during the stroke. The shaft 10 passes in front of the golf ball 24 allowing the golfer's hands to pull through the golf ball 24 for a solid feel. This results in a natural pendulum motion as the putter 30 is brought through the course of a stroke. The golfer is better able to align his putter in relation to the golf ball. In addition, the golfer is able to more accurately aim the golf ball along the desired course.

I claim:

1. An offset golf putter comprising a shaft portion, an offset portion and a head, said shaft having a grip portion and an elongated shank, said offset portion having an upstanding portion, an intermediate portion and a downward portion, said head having an upper surface, a downwardly depending forward face, a downwardly depending rearward face, a lower face, an outer end portion and an inner end portion, when said golf putter is in an operable position said grip portion is attached to the upper end of the shank, said upstanding portion having one end attached to the lower end of the shank, said upstanding portion terminates at the other end at said intermediate portion which extends substantially horizontally and vertically from said upstanding portion, said intermediate portion terminates at said downward portion which extends substantially downwardly from said intermediate portion, said downward portion terminates at said upper surface and is affixed to said head proximate said outer end, said upper surface is substantially horizontal, whereby when said golf putter is positioned said outer end of the putter is positioned furthermost from a golfer's body so that the shaft passes in front of said head in a plane substantially parallel to the head, thereby, when viewed by a golfer the ball is positioned adjacent said downwardly depending forward face of the head, said intermediate portion of the offset portion and said shaft.

2. The golf putter of claim 1 wherein both the inner and outer ends of the head are curved downwardly and inwardly.

3. The golf putter of claim 1 wherein the intermediate portion of the offset portion extends laterally from the upper surface of the head at about a 45 degree angle.

4. The golf putter of claim 1 wherein the intermediate portion of the offset portion extends laterally from the upper surface of the head at an angle of 0° to 60°.

5. The golf putter of claim 4 wherein the intermediate portion of the offset portion extends away from the shaft at about a 45 degree angle.

6. The golf putter of claim 4 wherein the intermediate portion of the offset portion extends away from the shaft at an angle of 90° to 150°.

7. The golf putter of claim 1 wherein the shank has a greater cross-sectional dimension than the cross-sectional dimension of said offset portion.

8. The golf putter of claim 1 wherein the head consists essentially of a unitary piece.

9. The golf putter of claim 1 wherein the downwardly depending forward face is at about a 90 degree angle with the upper surface.

10. The golf putter of claim 1 wherein the downwardly depending rearward face is at about a 90 degree angle with the upper surface.

11. The golf putter of claim 1 wherein the downwardly depending forward face and the downwardly depending rearward face are at about a 90 degree angle with the upper surface.

* * * * *